US010534306B2

(12) United States Patent
Nakatsugawa

(10) Patent No.: US 10,534,306 B2
(45) Date of Patent: Jan. 14, 2020

(54) BASE BODY, ELECTROPHOTOGRAPHIC PHOTORECEPTOR, AND IMAGE FORMING APPARATUS

(71) Applicant: KYOCERA CORPORATION, Kyoto (JP)

(72) Inventor: Haruki Nakatsugawa, Higashiomi (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/210,822

(22) Filed: Dec. 5, 2018

(65) Prior Publication Data

US 2019/0179248 A1 Jun. 13, 2019

(30) Foreign Application Priority Data

Dec. 8, 2017 (JP) ..... 2017-236341

(51) Int. Cl.

| | |
|---|---|
| ***G03G 5/08*** | (2006.01) |
| ***G03G 15/00*** | (2006.01) |
| ***G03G 5/043*** | (2006.01) |
| ***G03G 5/082*** | (2006.01) |
| *G03G 5/147* | (2006.01) |

(52) U.S. Cl.

CPC ..... *G03G 15/75* (2013.01); *G03G 5/043* (2013.01); *G03G 5/08214* (2013.01); *G03G 5/147* (2013.01)

(58) Field of Classification Search

CPC ..... G03G 15/751; G03G 5/14704; G03G 5/08235

See application file for complete search history.

(56) References Cited

U.S. PATENT DOCUMENTS

2008/0003016 A1* 1/2008 Nakano ..... G03G 15/752 399/159

FOREIGN PATENT DOCUMENTS

JP 2017-155269 A 9/2017

OTHER PUBLICATIONS

International Search Report dated Jun. 6, 2017, in corresponding International Application No. PCT/JP2017/009280.

* cited by examiner

*Primary Examiner* — Walter L Lindsay, Jr.
*Assistant Examiner* — Jessica L Eley
(74) *Attorney, Agent, or Firm* — Duane Morris LLP

(57) ABSTRACT

A cylindrical base body of the disclosure includes an outer peripheral surface and an end surface which is connected to the outer peripheral surface. The outer peripheral surface includes a first inclined surface which is inclined inwardly toward the end surface, the end surface includes a second inclined surface which is inclined inwardly toward the outer peripheral surface and is connected to the first inclined surface, and a connecting portion of the first inclined surface and the second inclined surface has a radiused surface.

5 Claims, 3 Drawing Sheets

BASE BODY, ELECTROPHOTOGRAPHIC PHOTORECEPTOR, AND IMAGE FORMING APPARATUS

BACKGROUND OF THE INVENTION

1. Field of the Invention

The present invention relates to a base body, an electrophotographic photoreceptor, and an image forming apparatus including the same.

2. Description of the Related Art

An electrophotographic photoreceptor used in an image forming apparatus, for example, an electrophotographic photoreceptor having a cylindrical base body and a photoconductive layer is known (for example, Japanese Unexamined Patent Publication JP-A 2017-155269).

Such an image forming layer is required to stabilize printing quality.

SUMMARY OF THE INVENTION

A cylindrical base body of the present disclosure includes an outer peripheral surface and an end surface connected to the outer peripheral surface. The outer peripheral surface has a first inclined surface which is inclined inwardly toward the end surface, the end face has a second inclined surface which is inclined inwardly toward the outer peripheral surface and is connected to the first inclined surface, and a connecting portion of the first inclined surface and the second inclined surface has a radiused surface.

An electrophotographic photoreceptor of the present disclosure includes the above-described cylindrical base body and a photoconductive layer which is disposed on the cylindrical base body from the end surface to the outer peripheral surface of the cylindrical base body.

An image forming apparatus of the present disclosure includes the above-described electrophotographic photoreceptor and an exposure device which irradiates the electrophotographic photoreceptor with light.

According to the cylindrical base body, the electrophotographic photoreceptor, and the image forming apparatus of the present disclosure, it is possible to stabilize the printing quality in the image forming apparatus.

BRIEF DESCRIPTION OF THE DRAWINGS

Other and further objects, features, and advantages of the invention will be more explicit from the following detailed description taken with reference to the drawings wherein.

DETAILED DESCRIPTION

Hereinafter, a base body and an electrophotographic photoreceptor according to an embodiment of the invention and an image forming apparatus including the same will be described with reference to drawings. The following contents illustrate the embodiments of the invention, and the invention is not limited to the example of the embodiment.

An electrophotographic photoreceptor 10 has a cylindrical shape and is incorporated into an image forming apparatus to be described later, and may form an image by rotating around a rotation axis extending along a longitudinal direction of the cylindrical shape.

Figure 1A:
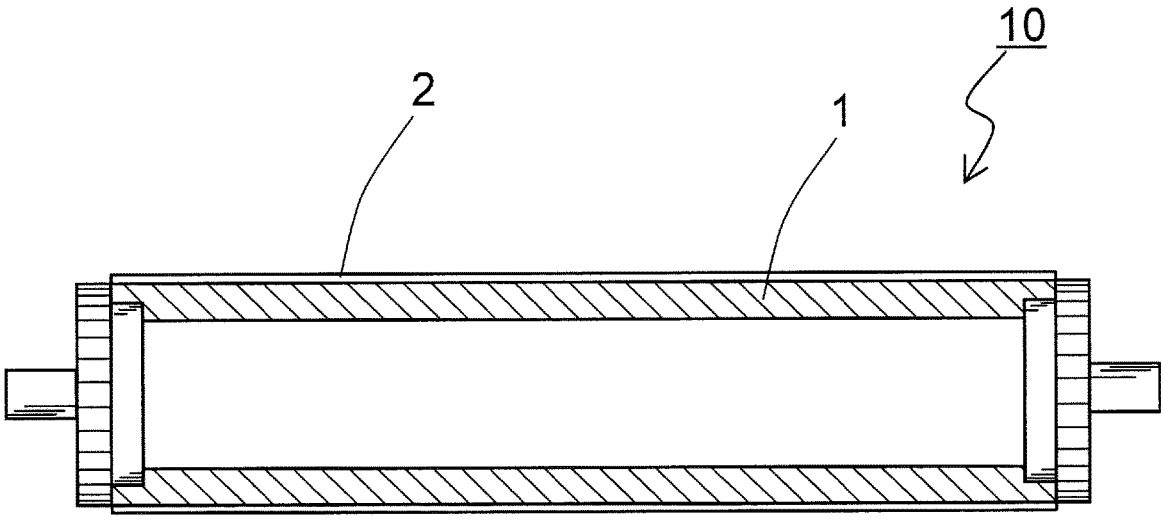
FIG. 1A is a half cross sectional view showing an electrophotographic photoreceptor according to an embodiment of the invention.
Figure 1B:
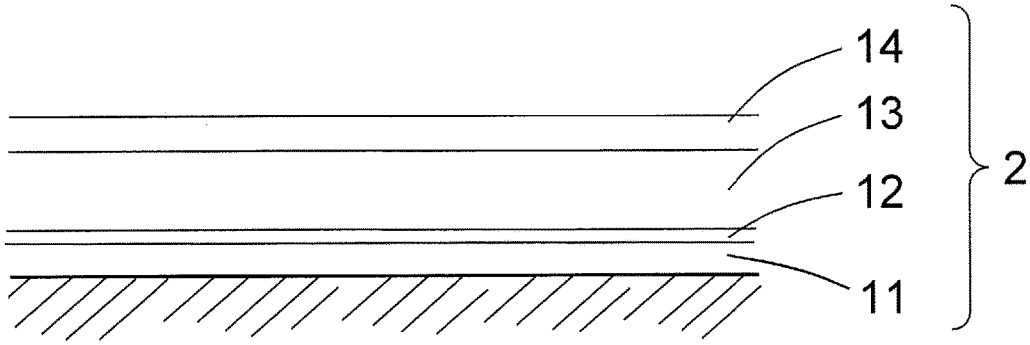
FIG. 1B is a schematic cross sectional view enlarging a part of FIG. 1A.

Referring to FIGS. 1A and 1B, the electrophotographic photoreceptor 10 comprises a cylindrical base body 1 and a plurality of layers 2 disposed on the base body 1. The plurality of layers 2 include a voltage resistance layer 11 disposed on the base body 1, a charge injection blocking layer 12 disposed on the voltage resistance layer 11, a photoconductive layer 13 disposed on the charge injection blocking layer 12, and a surface protective layer 14 disposed on the photoconductive layer 13.

The electrophotographic photoreceptor 10 may be formed by sequentially forming the voltage resistance layer 11, the charge injection blocking layer 12, the photoconductive layer 13, and the surface protective layer 14 on the base body 1 using a deposition film forming apparatus, for example.

The base body 1 may support the plurality of layers 2. At least the surface of the cylindrical base body 1 has conductivity. The cylindrical base body 1 may be formed to have conductivity as a whole by a metal material such as aluminum (Al), stainless steel (SUS), zinc (Zn), copper (Cu), iron (Fe), Titanium (Ti), nickel (Ni), chromium (Cr), tantalum (Ta), tin (Sn), gold (Au), silver (Ag), magnesium (Mg), and manganese (Mn), or an alloy including these exemplified metal materials.

The cylindrical base body 1 may be coated with a conductive film made of the exemplified metal material and a transparent conductive material such as indium tin oxide (ITO) or $SnO_2$ (tin dioxide) on a surface of a resin, glass, ceramics, or the like.

When the base body 1 is formed of an aluminum (Al) based material, the electrophotographic photoreceptor 10 may be produced lightweight at low cost. When the charge injection blocking layer 12 and the photoconductive layer 13 are formed of an amorphous silicon (a-Si) based material, the adhesion between the charge injection blocking layer 12, the photoconductive layer 13, and the base body 1 is increased, thereby improving the reliability.

Figure 2:
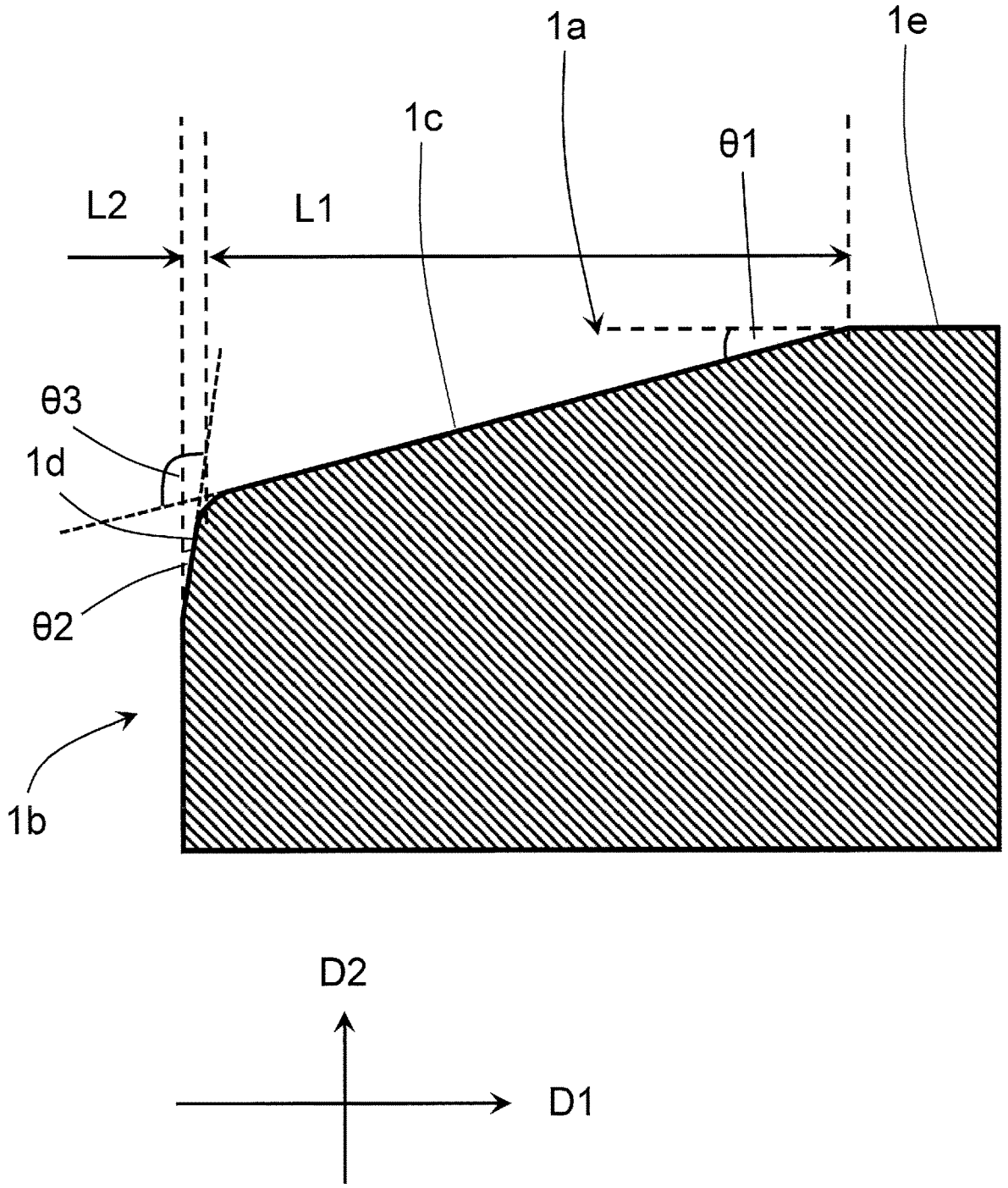
FIG. 2 is a schematic diagram enlarging a part of a base body of the present disclosure.

Referring to FIG. 2, the base body 1 includes an outer peripheral surface 1*a*. The outer peripheral surface 1*a* is a surface extending along the circumference direction of the cylindrical base body 1. That is, when the base body 1 is regarded as a cylindrical column, the surface of the portion corresponding to the side surface of the cylindrical column is defined as the outer peripheral surface 1*a*.

The outer peripheral surface 1*a* is a mirror surface or a rough surface. When the outer peripheral surface 1*a* is a mirror surface, the surface roughness of the outer peripheral surface 1*a* may be, for example, an arithmetic mean height Sa of less than 25 nm. In the embodiment, a region (surface region) where the arithmetic mean height Sa of the surface is less than 25 nm is referred to as a "mirror surface".

On the other hand, when the outer peripheral surface 1*a* is a rough surface, the surface roughness of the outer peripheral surface 1*a* may have, for example, the arithmetic mean height Sa of 50 nm or more and 140 nm or less. In the embodiment, a region (surface region) where the arithmetic mean height Sa of the surface is 25 nm or more is called "rough surface".

The arithmetic mean height Sa used in the specification is one of parameters representing a three-dimensional surface texture defined by ISO 25178 and represents the arithmetic average (nm) of the absolute value of the height from the average plane of the surface in the measurement target region. For this measurement, the surface shape has been measured by three-dimensional roughness parameters according to ISO 25178 by a three-dimensional measurement laser microscope OLSA 4100 manufactured by Olympus Corporation.

The surface roughness of the base body 1 does not necessarily have to fall within a predetermined range on the entire outer peripheral surface 1*a*. For example, the surface texture may fall outside the range at both axial ends of the cylindrical base body 1.

The outer peripheral surface of the base body 1 according to the embodiment is a mirror surface.

The base body 1 further includes an end surface 1*b* connected to the outer peripheral surface 1*a*. The end surface 1*b* is a surface which intersects a direction of the rotation axis of the cylindrical base body 1. That is, when the base body 1 is regarded as a cylindrical column, the surface of the portion corresponding to the bottom surface of the cylindrical column is defined as the end surface 1*b*.

The outer peripheral surface 1*a* of the base body 1 includes a first inclined surface 1*c*. The first inclined surface 1*c* is inclined inwardly toward the end surface 1*b*. In other words, the first inclined surface 1*c* is inclined so that a length in a radial direction of the cylindrical base body 1 is reduced.

The end surface 1*b* of the base body 1 includes a second inclined surface 1*d*. The second inclined surface 1*d* is inclined inwardly toward the outer peripheral surface 1*a*. In other words, the second inclined surface 1*d* is inclined so that a length in an axial direction of the cylindrical base body 1 is reduced.

The first inclined surface 1*c* and the second inclined surface 1*d* are connected to each other. A connecting portion of the first inclined surface 1*c* and the second inclined surface 1*d* has a radiused surface.

The plurality of layers 2 are disposed on the base body 1 from the end surface 1*b* to the outer peripheral surface 1*a* of the base body 1. More specifically, the plurality of layers 2 are disposed at least from the second inclined surface 1*d* to the outer peripheral surface 1*a*.

Here, for example, when the outer peripheral surface or the end surface of the base body has no inclined surface, or when the connecting portion of the outer peripheral surface and the end surface has no radiused surface, for example, due to a difference in thermal expansion amount between the base body and the plurality of layers, a part of the plurality of layers may be peeled off from the connecting portion of the outer peripheral surface and the end surface. The part of the plurality of peeled layers is mixed during printing, which sometimes deteriorates the printing quality.

On the contrary, since the invention of the present disclosure includes the above-described configuration, it is possible to increase an angle of the connecting portion of the outer peripheral surface 1*a* and the end surface 1*b*, thereby reducing stress concentration at the connection portion due to thermal expansion of the base body and the plurality of layers 2. Also, since the connecting portion of the outer peripheral surface 1*a* and the end surface 1*b* has the radiused surface in the invention of the present disclosure, it is possible to further reduce stress concentration at the connection portion due to thermal expansion of the base body 1 and the plurality of layers 2. Therefore, it is possible to reduce peeling of a part of the plurality of layers 2 and to further stabilize the printing quality in the image forming apparatus.

An angle (a first angle θ1) with respect to a first direction D1 along the rotation axis of the base body 1 of the first inclined surface 1*c* is set to, for example, 10° or more and 30° or less. The first angle θ1 of the first inclined surface 1*c* may be 25° or less. In this case, as shown in Table 1, it is possible to reduce the peeling of a part of a plurality of layers 2 at a connecting portion of the first inclined surface 1*c* and a first non-inclined surface 1*e* of the outer peripheral surface 1*a*.

The "first angle" in Table 1 indicates the first angle θ1 of the first inclined surface 1*c*, and "presence or absence of peeling off" is a result of observing whether or not a part of the plurality of layers 2 has peeled off when the first angle θ1 is changed. The presence or absence of peeling off is determined by visual observation or observation using a microscope. A ratio of peeling off in the circumferential direction indicates an area ratio of the film peeling on the circumference at the first inclined surface 1*c*. For example, when the film peeling is not observed on the circumference at the first inclined surface 1*c*, the ratio of peeling off in the circumferential direction is defined as 0%. When the film peeling is observed on half of the circumference in terms of area ratio, the ratio of peeling off in the circumferential direction is defined as 50%. When the film peeling is observed on the entire circumference, the ratio of peeling off in the circumferential direction is defined as 100%.

TABLE 1

| No. | First angle | Presence/absence of peeling off | Ratio of peeling off in circumferential direction |
|---|---|---|---|
| 1 | 10° | Absent | 0.0% |
| 2 | 20° | Absent | 0.0% |
| 3 | 25° | Absent | 0.0% |
| 4 | 30° | Present | 1.4% |

The first angle θ1 of the first inclined surface 1*c* may be 15° or more. In this case, it is possible to shorten the dimension in the first direction D1 and ensure a wide image area.

In the embodiment, the first angle θ1 of the first inclined surface 1*c* is set to 20°.

The first inclined surface 1*c* is flat. As a result, in the case of roughening the outer circumferential surface of the base body 1 or mirror surface processing, it is possible to reduce the influence of variation in a turning tool contact position and maintain the first angle θ1.

A second angle θ2 with respect to a second direction D2 orthogonal to the rotation axis (or the first direction D1) of the base body 1 of the second inclined surface 1*d* is set to, for example, 5° or more and 10° or less. By having the second inclined surface 1*d* on the end surface 1*b*, it is possible to reduce wraparound of the plurality of layers 2. In the embodiment, the second angle θ2 of the second inclined surface 1*d* is set to 7°.

The second inclined surface 1*d* is flat. As a result, it is possible to reduce wraparound of the plurality of layers 2.

A third angle θ3 at which the virtual straight line of the first inclined surface 1*c* intersects the virtual straight line of the second inclined surface 1*d* may be 90° or more and 180° or less. In the embodiment, the third angle θ3 is set to 117°.

The first angle θ1 of the first inclined surface 1*c* may be larger than the second angle θ2 of the second inclined surface 1*d*. As a result, it is possible to reduce wraparound of the plurality of layers 2 with respect to the second direction D2.

The radius of the radiused surface of the connecting portion of the first inclined surface 1*c* and the second inclined surface 1*d* may be, for example, 0.05 mm to 0.5 mm. In the embodiment, the radius of the radiused surface is set to 0.08 mm.

A linear component along the first direction D1 of the first inclined surface 1*c* may be larger than a linear component along the second direction D2 of the second inclined surface 1*d* in the side sectional view passing through the rotation axis. As a result, even when the surface of the base body 1 is cut during the processing of the surface of the base body 1 or the like, it is possible to reduce the loss of the first inclined surface 1*c*. At least a linear component L1 along the first direction D1 of the first inclined surface 1*c* may be larger than a linear component L2 along the first direction D1 of the second inclined surface 1*d* before forming the plurality of layers 2.

In the base body 1 according to the embodiment, the linear component along the first direction D1 of the first inclined surface 1*c* before forming the plurality of layers 2 is, for example, 0.1 mm to 0.6 mm when the rotation axis is viewed from the side section. The linear component along the second direction D2 of the first inclined surface 1*c* is, for example, 0.05 mm to 0.4 mm. The linear component along the first direction D1 of the second inclined surface 1*d* is, for example, 0.02 mm to 0.1 mm. The linear component along the second direction D2 of the second inclined surface 1*d* is, for example, 0.2 mm to 0.5 mm.

The base body 1 may be formed by a well-known method in the related art.

Each layer of the plurality of layers 2 will be described below.

The voltage resistance layer 11 may improve the withstand voltage characteristics of the surface coating layer. The voltage resistance layer 11 may be a layer containing amorphous silicon nitride (a-SiN). The ratio (N/(Si+N)) of the number of nitrogen atoms to the total number of nitrogen atoms and silicon atoms in the voltage resistance layer 11 may be set to 0.32 or less. By setting the ratio of silicon atoms and nitrogen atoms in such a range, it is possible to appropriately ensure withstand voltage characteristics in a plurality of layers 2 and appropriately suppress generation of residual potential. For the voltage resistance layer 11, for example, amorphous silicon (a-Si) containing at least nitrogen (N) as a dopant may be used. The thickness of the voltage resistance layer 11 is, for example, 0.5 to 15 μm. The voltage resistance layer 11 is also referred to as a withstand voltage layer or a withstand voltage holding layer.

The charge injection blocking layer 12 may reduce the injection of carriers (electrons or holes) from the cylindrical base body 1. The charge injection blocking layer 12 may be formed of, for example, an amorphous silicon (a-Si) based material. For the charge injection blocking layer 12, for example, amorphous silicon (a-Si) containing boron (B) as a dopant and optionally nitrogen (N) or oxygen (O) or both, or amorphous silicon (a-Si) containing phosphorus (P) and optionally nitrogen (N) or oxygen (O) or both may be used. A thickness of the charge injection blocking layer 12 is, for example, 2 to 10 μm.

The photoconductive layer 13 may generate carriers by light irradiation such as laser light. The photoconductive layer 13 may be formed of, for example, an amorphous silicon (a-Si) based material and an amorphous selenium (a-Se) based material such as Se—Te or $As_2Se_3$. The photoconductive layer 13 of the present example is formed of amorphous silicon (a-Si) and an amorphous silicon (a-Si) based material obtained by adding carbon (C), nitrogen (N), oxygen (O) and the like to amorphous silicon (a-Si), and boron (B) or phosphorus (P) is contained as a dopant. In the case of forming the photoconductive layer 13 using an amorphous silicon (a-Si) based material, a thickness thereof may be set to about 5 to 100 μm, or more specifically 10 to 80 μm.

The surface protective layer 14 may protect the surface of the photoconductive layer 13. For example, an amorphous silicon (a-Si) based material such as amorphous silicon carbide (a-SiC) or amorphous silicon nitride (a-SiN) or amorphous carbon (a-C) may be used for the surface protective layer 14, or a multilayer structure thereof may be adopted. In the present example, amorphous carbon (a-C) with high durability is adopted for the surface protective layer 14, which is the outermost surface after formation of the layers, in terms of the wear resistance against rubbing in the image forming apparatus. A thickness of the surface protective layer 14 may be adjusted according to the required number of durable sheets of the electrophotographic photoreceptor 10, and it is not necessary to make the surface protective layer 14 thicker than necessary. For example, the thickness should be set to 0.1 to 2 μm, or more specifically 0.5 to 1.5 μm.

The plurality of layers 2 may be formed using a plasma chemical vapor deposition (CVD) apparatus. More specifically, a plurality of base bodies 1 may be placed to be stacked in the first direction D1, and gases are introduced for formation of each layer, whereby the plurality of layers 2 may be formed.

Figure 3:
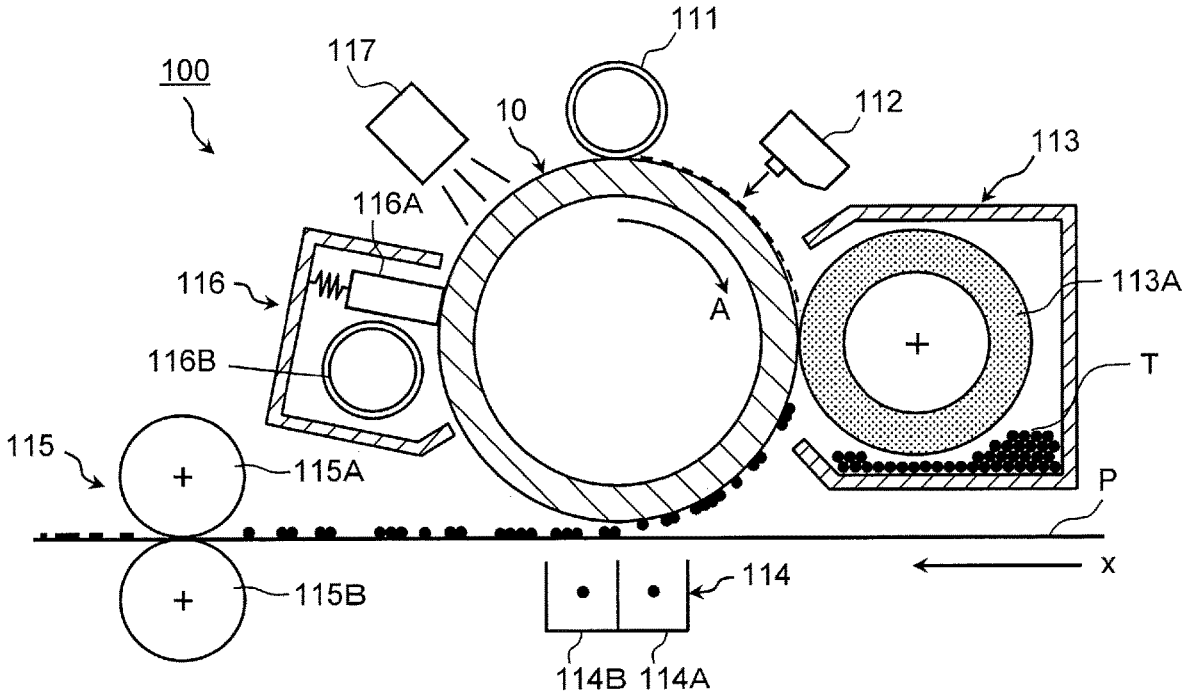
FIG. 3 is a schematic diagram of an image forming apparatus of the present disclosure.

Next, an image forming apparatus according to the embodiment of the invention will be described with reference to FIG. 3.

An image forming apparatus 100 employs the Carlson process as an image forming process and includes the electrophotographic photoreceptor 10, a charging device 111, an exposure device 112, a developing device 113 including a developing roller 113A, a transfer device 114, a fixing device 115 (115A and 115B), a cleaning device 116 including a cleaning roller 116B and a cleaning blade 116A in contact with the electrophotographic photoreceptor 10, and a static eliminating device 117. An arrow x in the drawing indicates a moving direction of a paper sheet which is a recording medium P.

The charging device (charging roller) ill has a function of charging the surface of the electrophotographic photoreceptor 10 with negative polarity. In the embodiment, the charging device 111 employs, for example, a contact-type charging device configured by covering a core metal with a conductive rubber or polyvinylidene fluoride (PVDF).

The exposure device 112 has a function of forming an electrostatic latent image on the electrophotographic photoreceptor 10. As the exposure device 112, for example, a light emitting diode (LED) head where a plurality of LED elements (wavelength: 680 nm) are arrayed may be adopted.

The developing device 113 has a function of developing an electrostatic latent image of the electrophotographic photoreceptor 10 to form a toner image. The developing device 113 in the present example includes the developing roller 113A magnetically holding a developer (toner) T.

The developer (toner) T is configured to have a toner image formed on the surface of the electrophotographic photoreceptor 10 and is frictionally charged in the developing device 113. Examples of the toner T include a two-component type developer containing a magnetic carrier and an insulating toner and a one-component developer containing a magnetic toner.

A magnetic roller 113A has a function of transporting the toner T to the surface (development area) of the electrophotographic photoreceptor 10. The magnetic roller 113A transports the frictionally charged developer T in the developing device 113 in the form of a magnetic brush adjusted to a constant length. The transported toner T adheres to the surface of the electrophotographic photoreceptor 10 due to the electrostatic attraction with the electrostatic latent image in the development area of the electrophotographic photoreceptor 10 to form a toner image (to visualize the electrostatic latent image).

In the present example, the developing device 113 employs a dry developing process, but a wet developing process using a liquid developer may be adopted. In some cases, a transporting screw (spiral type) for stirring unused toner T may be disposed in the developing device 113.

The transfer device 114 has a function of transferring the toner image of the electrophotographic photoreceptor 10 to the recording medium P such as a paper supplied to a transfer area between the electrophotographic photoreceptor 10 and the transfer device 114. The transfer device 114 in the present example includes a transfer charger 114A and a separating charger 114B.

As the transfer device 114, it is also possible to use a transfer roller driven by the rotation of the electrophotographic photoreceptor 10 and disposed with a minute gap (for example, 0.5 mm or less) from the electrophotographic photoreceptor 10. The transfer roller is configured to apply a transfer voltage which attracts the toner image on the electrophotographic photoreceptor 10 onto the recording medium P by, for example, a DC power supply.

The fixing device 115 has a function of fixing the toner image transferred onto the recording medium P and includes a pair of fixing rollers 115A and 115B. The fixing rollers 115A and 115B are, for example, metal rollers coated with tetrafluoroethylene or the like.

The cleaning device 116 has a function of removing the toner T remaining on the surface of the electrophotographic photoreceptor 10 and includes the cleaning roller 116B and the cleaning blade 116A. The cleaning roller 116B has a crown shape with a large diameter at the center, and is in sliding contact with the outer periphery of the electrophotographic photoreceptor 10 to form a toner film for surface cleaning formed of a residual toner T therebetween. The cleaning blade 116A has a function of scraping the residual toner from the surface of the electrophotographic photoreceptor 10. The cleaning blade 116A is formed of, for example, a rubber material containing polyurethane resin as a main component.

The static eliminating device 117 has a function of removing the surface charge of the electrophotographic photoreceptor 10 and is capable of emitting light having a specific wavelength (for example, 630 nm or more). The static eliminating device 117 is configured to remove the surface charge (residual electrostatic latent image) of the electrophotographic photoreceptor 10 by irradiating the entire axial direction of the surface of the electrophotographic photoreceptor 10 with light from a light source such as an LED.

In the image forming apparatus 100 of the embodiment, the above-described effects of the electrophotographic photoreceptor 10 may be exerted.

It is needless to say that the invention is not limited only to the above-described embodiments, and thus various changes, modifications and improvements are possible without departing from the scope of the invention.

What is claimed is:

1. A cylindrical base body, comprising:

an outer peripheral surface;

an end surface connected to the outer peripheral surface, the outer peripheral surface including a first inclined surface which is inclined inwardly toward the end surface, a first angle θ1 of the first inclined surface with respect to a first direction D1 being in the range of 10° to 25° , wherein the first direction D1 is a longitudinal direction of the cylindrical base body, the end surface including a second inclined surface which is inclined inwardly toward the outer peripheral surface and is connected to the first inclined surface, a second angle θ2 of the second inclined surface with respect to a second direction D2 being in the range of 5° to 10°, wherein the second direction D2 is orthogonal to the first direction Dl; and a connecting portion of the first inclined surface and the second inclined surface having a radiused surface, wherein a radius of the radiused surface is in the range of 0.05 millimeters (mm) to 0.5 mm.

2. The cylindrical base body according to claim 1, wherein in a side sectional view passing through a rotation axis of the cylindrical base body, a linear component along the first direction D1 of the first inclined surface is larger than a linear component along the first direction D1 of the second inclined surface.

3. An electrophotographic photoreceptor, comprising:

the cylindrical base body according to claim 1; and a photoconductive layer which is disposed on the cylindrical base body from the end surface to the outer peripheral surface of the cylindrical base body.

4. An image forming apparatus, comprising:

the electrophotographic photoreceptor according to claim 3; and an exposure device which irradiates the electrophotographic photoreceptor with light.

5. The cylindrical base body according to claim 2, wherein a linear component along the first direction D1 of the first inclined surface has a length in the range of 0.1 mm to 0.6 mm, and a linear component along the first direction D1 of the second inclined surface has a length in the range of 0.02 mm to 0.1 mm.

* * * * *